United States Patent [19]

Birat et al.

[11] 4,026,346

[45] May 31, 1977

[54] LIQUID-COOLED MOLD FOR CONTINUOUS CASTING OF MOLTEN METAL

[75] Inventors: Jean Pierre Birat; Louis Vedda, both of Metz, France

[73] Assignee: Institut de Recherches de la Siderurgie Francaise (IRSID), St. Germain-en-Laye, France

[22] Filed: June 24, 1976

[21] Appl. No.: 699,353

[30] Foreign Application Priority Data

June 27, 1975 France ..... 75.20225

[52] U.S. Cl. ..... 164/147; 164/283 M

[51] Int. Cl.[2] ..... B22D 11/04; B22D 27/02

[58] Field of Search ..... 164/49, 147, 250, 283 M

[56] References Cited

UNITED STATES PATENTS 3,941,183 3/1976 Vedda et al. ..... 164/147

*Primary Examiner*—Robert D. Baldwin

*Attorney, Agent, or Firm*—Kurt Kelman

[57] ABSTRACT

A tubular mold element is concentrically surrounded by a jacket defining an annular space therewith and a casing defining a chamber with the jacket. A liquid-tight element divides the chamber into a lower inlet chamber for a cooling liquid and an upper outlet chamber for the liquid. The annular space communicates at the respective ends of the jacket with the inlet and outlet chambers so that a cooling liquid film circulates through the space. The liquid-tight element comprises a first annular member affixed to the interior wall of the casing and a second annular member affixed to the exterior wall of the jacket so that the liquid-tight element supports the jacket at its lower end while its upper end is free of support. The upper end of the tubular mold element is supported in a central orifice of the mold cover which delimits the upper outlet chamber and the lower end of the mold element is centered liquid-tightly in a central orifice of the bottom mold wall delimiting the lower inlet chamber, the mold element being resiliently coupled to the bottom wall. An electromegnetic inductor is arranged in the outlet chamber for moving the molten metal in the passage of the mold element and the inductor is supported on the exterior wall of the tubular jacket.

14 Claims, 8 Drawing Figures

LIQUID-COOLED MOLD FOR CONTINUOUS CASTING OF MOLTEN METAL

Figure 1:
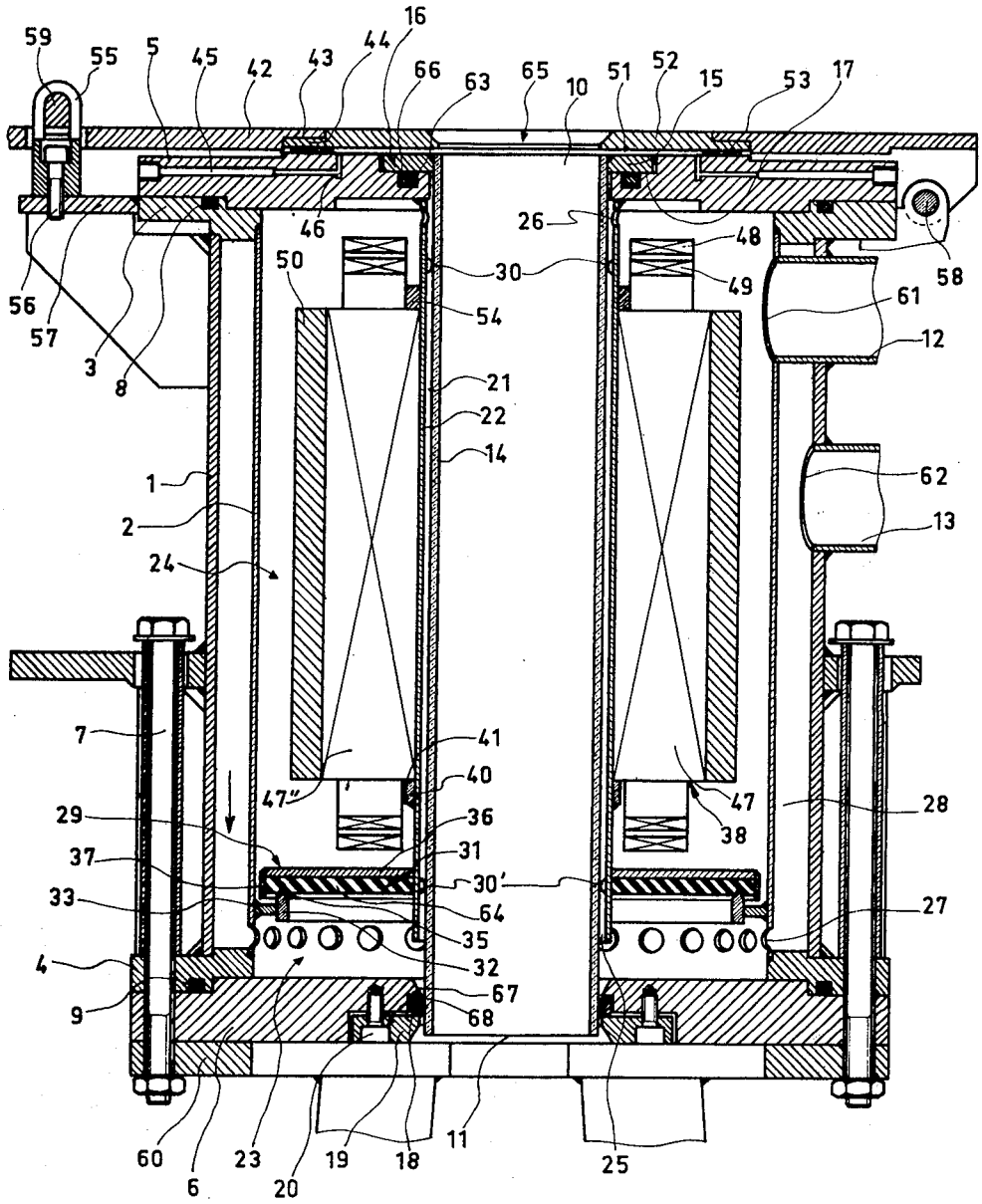

The present invention relates to improvements in a mold for the continuous casting of molten metal, and more particularly to a liquid-cooled mold of this type wherein the molten metal is electromagnetically moved in the mold passage.

During centrifugal continuous casting of molten metal, the molten metal descends slowly through the passage of a tubular mold element between the open ends thereof while being subjected to a rotational movement about the axis of the mold element. Compared to static continuous casting, setting the metal into rotative motion during casting has numerous advantages, such as better surface characteristics of the casting which permits laminating the same without a finishing operation, a well controlled solidification which assures a good internal structure and the absence of major segregations, etc.

Centrifugal casting has been accomplished with mechanical means, such as turning molds, as well as by the application of magneto-hydrodynamic principles, for which purposes the tubular mold element has been surrounded by an electromagnetic inductor with a rotating magnetic field. While the latter solution has the advantage of avoiding movable mechanical parts, it raises certain technological difficulties because the inductor must be so dimensioned that it produces a sufficiently intense magnetic field in the body of molten metal. Particularly when the metal of the mould is a good conductor, such as copper or a copper alloy, the magnetic field is considerably weakened as the metal passes through the mold. If the magnetic field is to be sufficiently strong, considerable electric charges must be applied to the inductor, which requires an efficient cooling system to prevent overheating.

In molds of this general type, it is very useful for facilitating their maintenance and servicing of its essential parts, such as the electromagnetic inductor or the tubular mold element, which is in direct contact with the casting, to make these parts removable and separable from each other so that they become readily accessible and may be disassembled. In addition, in view of the technical requirements to which it is subjected in such an operation, the electromagnetic part of such a mold is very expensive and it is, therefore, very desirable from an investment point of view if the same electromagnetic inductor can be used for casting ingots of different shapes and cross sections, or at least, to reduce to a small number the different inductors needed.

It is the primary object of this invention to provide these advantages in a liquid-cooled mold which comprises a tubular mold element of non-magnetic having two open ends and defining a passage for the casting between the open ends, a tubular jacket of non-magnetic material surrounding the tubular mold element and defining an annular space therewith, and a tubular casing surrounding the jacket and defining a chamber therewith, a liquid-tight element dividing the chamber into a lower inlet chamber for a cooling liquid and an upper outlet chamber for the liquid. The inlet and outlet chambers adjoin but are separated by the liquid-tight element, the outlet chamber extends over a substantial part of the length of the jacket, and the annular space communicates at the respective ends of the jacket with the inlet and outlet chambers, respectively, whereby a film of the cooling liquid circulates through the annular space when the liquid is supplied to the inlet chamber. A cover means and a bottom wall for the mold respectively delimit the upper outlet and the lower inlet chambers, the cover means and the bottom wall having central orifices in alignment with the open ends of the tubular mold element. An electromagnetic inductor means having projecting poles is arranged in the upper outlet chamber, the inductor means surrounding the jacket for moving the molten metal in the passage.

According to the invention, the liquid-tight element comprises two annular members, a first one of the annular members being affixed to the interior wall of the tubular casing near the lower end thereof and a second one of the annular members being affixed to the exterior wall of the tubular jacket near the lower end thereof, whereby the liquid-tight element supports the jacket at its lower end while the upper end thereof is free of support. Support means at the upper end of the tubular mold element holds the same in the central orifice of the cover means and a liquid-tight centering means holds the lower end of the tubular mold element in the central orifice of the bottom wall, the centering means providing a resilient coupling between the tubular mold element and the bottom wall. The inductor means is supported in the outlet chamber on the exterior wall of the tubular jacket.

According to one preferred embodiment of the present invention, the mold is designed for molding ingots or different cross sections and consists of a fixed mold part comprising the tubular casing, the first annular member of the liquid-tight element, the cover means and the bottom wall, and a replaceable mold part comprising the tubular mold element, the cross section of this element conforming to the desired cross section of the ingot to be molded, the tubular jacket, the second annular member of the liquid-tight element, and auxiliary magnetic pole members disposed between the jacket and the projecting poles of the magnetic inductor means. Means are provided for assembling the fixed and replaceable mold parts so that the auxiliary magnetic pole members adjoin, and are aligned with, corresponding ones of the poles.

In such a mold, the electromagnetic inductor will be disposed in immediate proximity to the surface of the casting while being directly cooled by the cooling liquid for the mold. The operative parts of the mold are readily accessible and disassembled. The liquid-tight element, which separates the inlet chamber of the cooling liquid from the outlet chamber, supports the jacket so that the latter is removably positioned in the interior of the mold. Similarly, the electromagnetic inductor is simply supported on the jacket in the outlet chamber. Furthermore, the jacket may have one or more longitudinal tongues positioned between the poles adjacent the inductor and serving simultaneously as guides for positioning the inductor and stops for preventing its rotation about the jacket under the coupling effect of the electromagnetic reaction. The tubular mold element itself, which is in direct contact with the casting and determines its shape, is suspended in the central orifice of the mold cover for ready removal and replacement. It is suitably centered by a resilient coupling to the bottom wall of the mold.

As has been indicated hereinabove, such a mold has the remarkable advantage of being adaptable to casting ingots of various shapes while using the same electromagnetic inductor. Furthermore, whatever the shape of the casting, the magnetic flux is brought as close as possible to the surface thereof to avoid closing the lines of magnetic force behind the cooling film of liquid.

Figure 2:
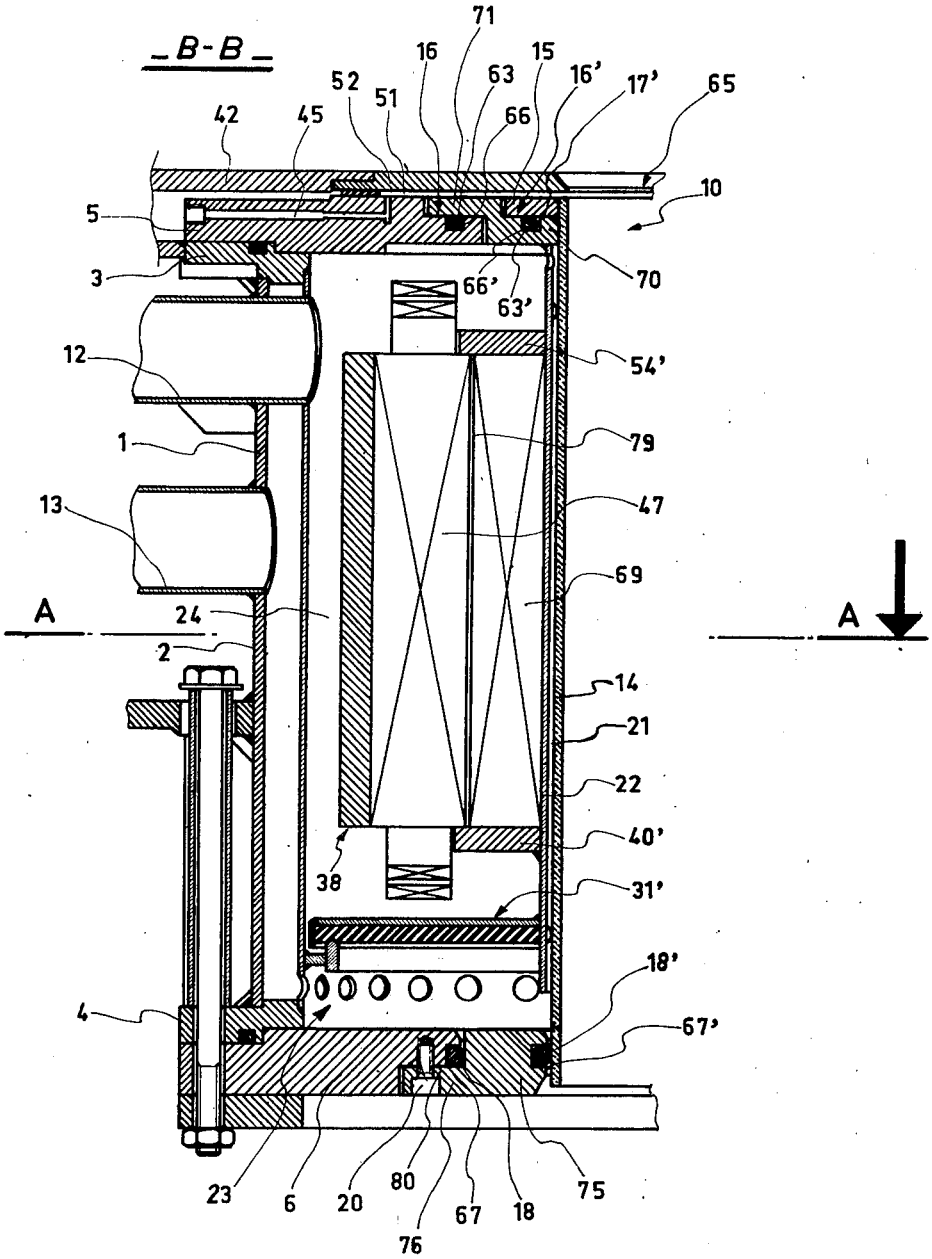
Figure 3A:
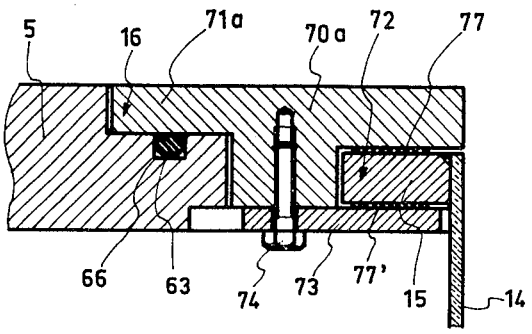
Figure 3B:
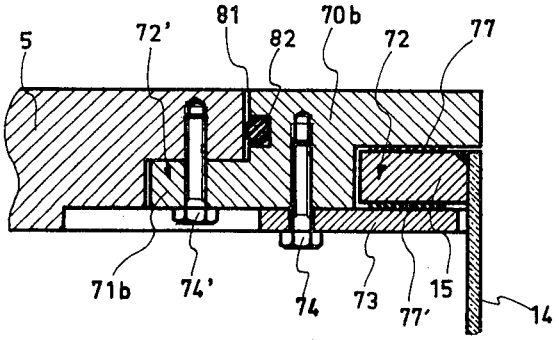
Figure 3C:
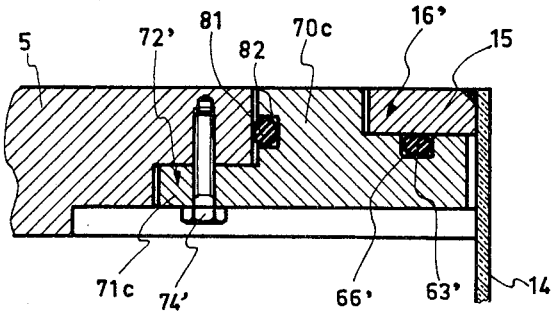
Figure 4A:
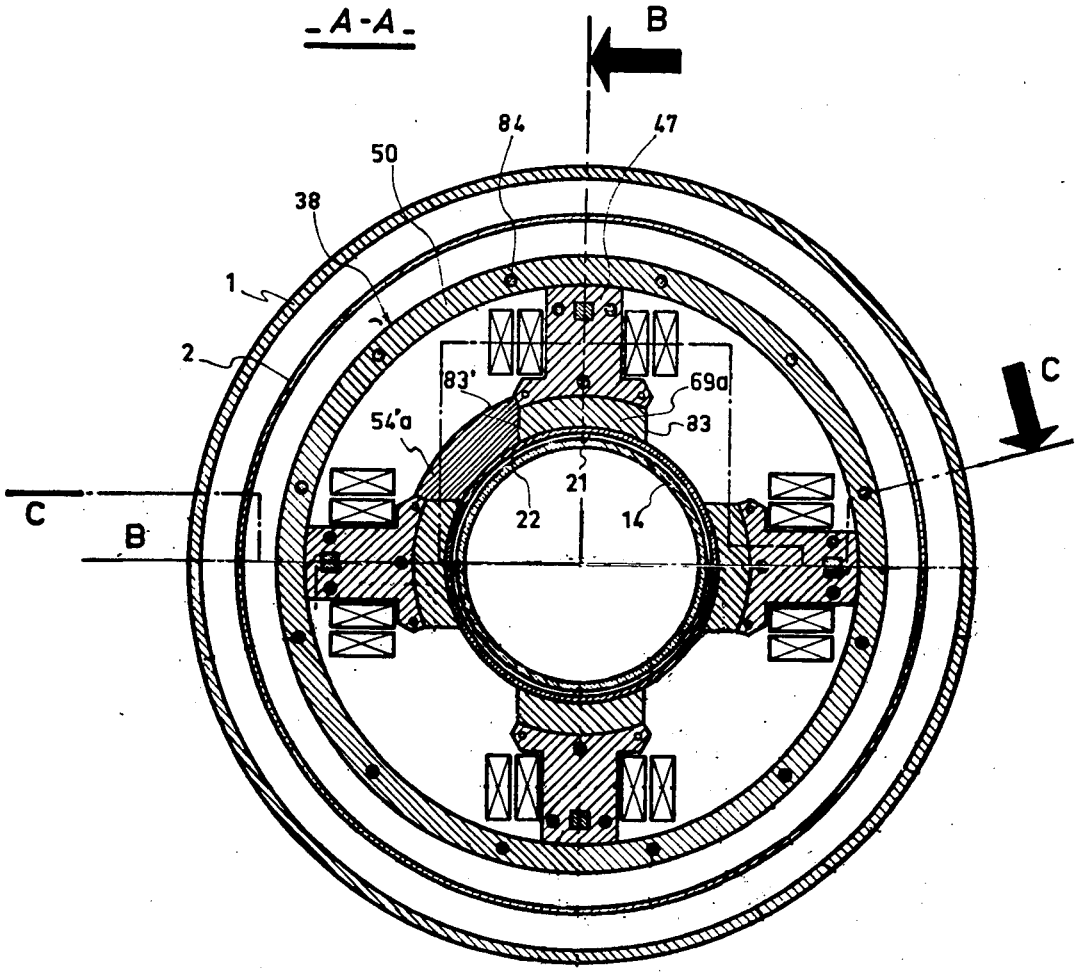
Figure 4B:
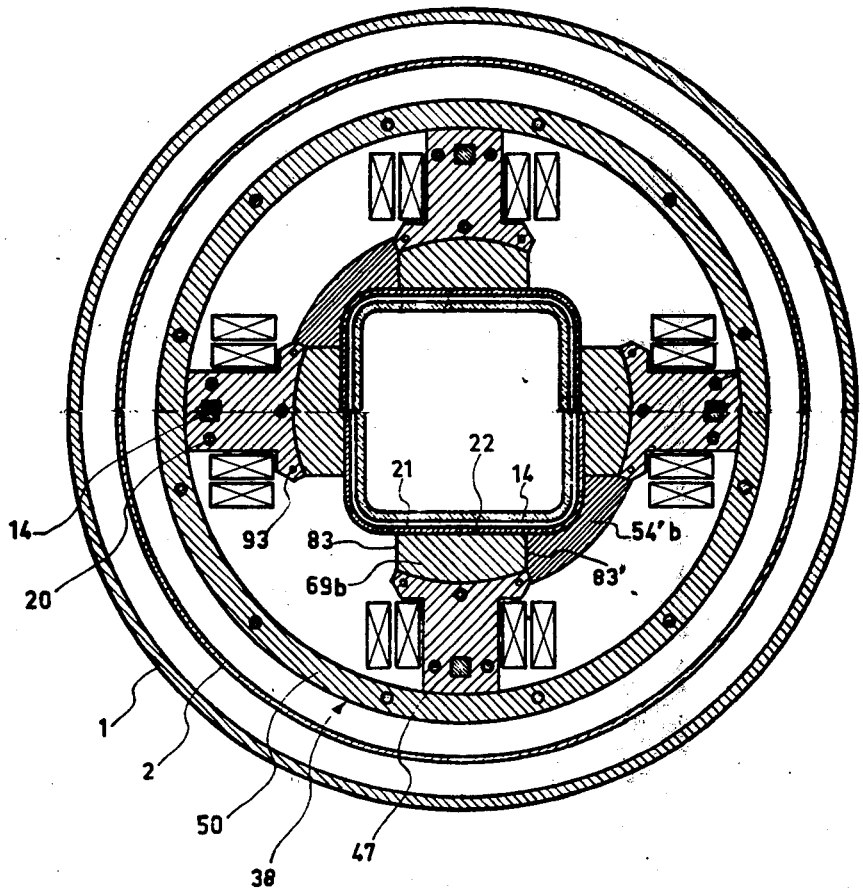
Figure 5:
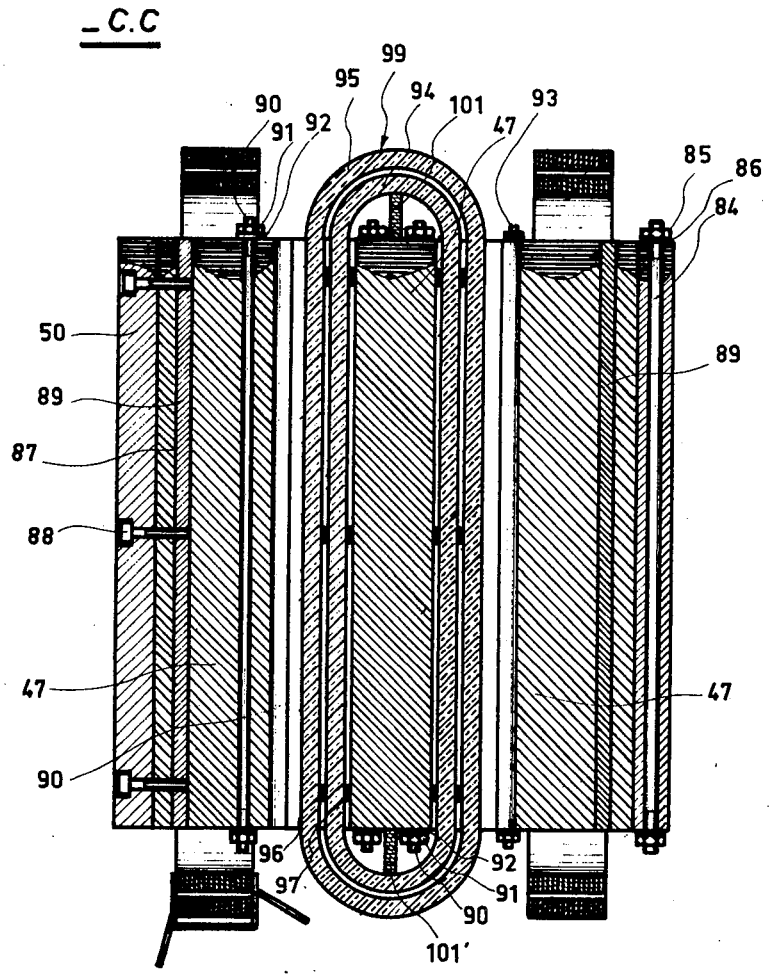

The above and other objects, advantages and features of this invention will become more apparent from the following detailed description of certain now preferred embodiments thereof, taken in conjunction with the accompanying drawing wherein FIG. 1 is a longitudinal section of one embodiment of a liquid-cooled mold for the continuous casting of molten metal according to the invention;

FIG. 2 is a longitudinal section along line BB of FIG. 4*a*, showing an embodiment of the mold adapted for casting ingots of different cross sections;

FIGS. 3*a*, 3*b* and 3*c* are enlarged sectional views of three modifications of means for supporting the upper end of the tubular mold element in the central orifice of the cover means of the mold;

FIG. 4*a* is a horizontal transverse section along line A—A of FIG. 2 with a tubular mold element shaped for casting round ingots and FIG. 4*b* is a corresponding transverse section with a tubular mold element shaped for casting rectangular ingots, and FIG. 5 is a longitudinal section of the electromagnetic inductor along line C—C of FIG. 4*a*, only the inductor parts being shown.

To avoid redundancy in the description, the same reference numerals designate like parts functioning in a like manner in FIGS. 1 and 2, as well as FIGS. 4*a*, 4*b* and 5.

Referring now to the drawing and first to FIG. 1, there is shown a liquid-cooled mold for the continuous casting of molten metal, which comprises tubular mold element 14 of non-magnetic material, such as copper or a copper alloy, having two open ends 10 and 11 and defining a passage for the casting between the open ends. Tubular jacket 22 of non-magnetic material, such as austenitic stainless steel surrounds the tubular mold element and defines annular space 21 therewith, and tubular casing 2 surrounds the jacket and defines a chamber therewith. The coaxial tubular mold element, jacket and casing are surrounded by outer tubular mold wall 1, end flanges 3 and 4 fixedly interconnecting outer mold wall 1 and casing 2. Cover means 5 has a central orifice receiving the upper end of the tubular mold element and bottom wall 6 has a central orifice receiving the lower end of the mold element, the central orifices of the mold cover and bottom being in alignment with the open ends of tubular mold element 14. Cover 5 is suitably affixed to end flange 3, for instance by means of screws or bolts (not shown), gasket 8 being interposed between the flange and cover. Bottom wall 6 is affixed to end flange 4 by four threaded tie rods 7, washer 60 being interposed between the bottom wall and nuts holding the tie rods in position, and the tie rods mounting the mold on a support frame. Gasket 9 is interposed between flange 4 and bottom wall 6, gaskets 8 and 9 assuring liquid tightness for the chamber defined by the double wall of the mold.

Liquid-tight element 29 divides the chamber into lower inlet chamber 23 for a cooling liquid and upper outlet chamber 24 for the liquid, the inlet and outlet chambers being adjoining but separated by the liquid-tight element and the outlet chamber extending over a substantial part of the length of jacket 22. Annular space 21 communicates at the respective ends of the jacket through ports 25 and 26 with the inlet and outlet chambers, respectively, whereby a film of the cooling liquid, such as water, circulates through the annular space when the liquid is supplied through inlet conduit 13 mounted in outer mold wall 1 and delivering the liquid through inlet port 62 into chamber 28, whence it flows through ports 27 into the inlet chamber for circulation through port 25 into annular space 21, where it ascends to port 26 into outlet chamber 24 and through outlet port 61 in casing 2 into outlet conduit 12 mounted in the outer mold wall and passing through chamber 28.

Tubular mold element 14 is held and centered in the mold by support means at the upper end of the tubular mold element supporting the mold element in the central orifice of the cover means and a centering means resiliently coupling the lower end of the mold element to the central orifice of the bottom wall. The illustrated support means at the upper end of mold element 14 comprises collar 15 affixed to the upper tubular mold element end and annular recess 26 defined by cover means 5 and receiving the collar so that the collar suspends the mold element on the cover, the collar resting on shoulder 17 defined by the recess. Toroidal gasket 63 is arranged in annular groove 66 in shoulder 17 to provide a liquid-tight joint. The illustrated centering means at the lower end of mold element 14 comprises toroidal gasket 18 of resilient material, such as rubber, and annular groove 67 defined in bottom wall 6 around the central orifice thereof and receiving gasket 18, the exterior wall of the tubular mold element pressing against the gasket which provides a resilient coupling between mold element 14 and bottom wall 6. Annular wedge 19 is mounted in recess 68 of bottom wall 6 and is affixed to the bottom wall by bolt 20 to hold gasket 18 in position.

As will now be explained and in accordance with the invention, liquid-tight element 29 does not only serve to separate the cooling liquid inlet chamber from the outlet chamber, which extends the length of jacket 22, but also to support the jacket in the mold. The jacket is preferably corrugated to impart added rigidity thereto and give it a satisfactory mechanical strength. The interior wall of the jacket carries upper and lower nipples 30, 30′ which properly center the jacket about tubular mold element 14, the upper end of the jacket extending to the inner surface of cover means 5 but being free of support.

As shown in FIGS. 1 and 2, liquid-tight element 29 comprises two independent members: annular stiffening member 31, which is an annular metal plate affixed to the exterior wall of tubular jacket 22 near the lower end thereof, and an annular member consisting of collar 32 and ring 33 affixed to the interior wall of tubular casing 2 near the lower end thereof. In this way, the annular member 32, 33 supports the jacket at its lower end. Stiffening member 31 carries annular skirt 37 extending towards ring 33 and defining an annular space with the jacket, the collar 32 carries annular ridge 35 extending towards the metal plate between skirt 37 and jacket 22, and liquid-tight gasket 64 is arranged in the annular space between the skirt and the jacket, the ridge supporting the gasket in the annular space. The upper surface 36 of the stiffening plate is preferably of non-magnetic stainless steel.

Electromagnetic inductor 38 of tubular structure is arranged in the upper outlet chamber 24 and occupies the major portion of its volume, the inductor surrounding jacket 22 and being designed to move the molten metal in the passage defined by tubular mold element 14. The upper end of the inductor is preferably disposed as close as possible to the upper end of the passage at orifice 10, where the liquid metal is introduced into the passage, so as to impart a rotary motion to the metal as soon as it enters the mold passage.

In the illustrated embodiment and as best shown in FIG. 4*a* or 4*b*, inductor 38 has two pairs of diametrically opposed poles only two of which 47 and 47'' are visible in FIG. 1. The projecting inductor poles are disposed in a regular array around jacket 22 and their inner ends conform to the exterior wall of the jacket with which they are in free contact over a substantial portion thereof corresponding more or less to the total length of the electromagnetic inductor. Each magnetic pole is surrounded by an inner and outer electrical winding 49, 48, and the entire inductor assembly is mounted in a magnetic cylinder 50. The poles and the cylinder are laminated in a conventional manner to minimize losses of Foucault currents.

A means on the exterior wall of jacket 22 supports inductor means 38 in outlet chamber 24, the illustrated support means comprising collar 40 affixed to the exterior wall, for instance by welding, the collar constituting abutment 41 maintaining the inductor means in the desired position in the outlet chamber. Tongues whose upper ends 54 are seen in FIG. 1 (see also FIG. 4*a* and 4*b*) are affixed to the exterior wall of the jacket and disposed between consecutive ones of magnetic poles 47, 47'' to prevent rotation of the inductor due to electromagnetic reaction forces, and the tongues may extend down to the level of abutment 41 to seve simultaneously as guides in mounting the inductor.

Cover plate 42 is hinged to upper flange 3 and 58 for removable positioning over cover means 5 of the mold. When the cover plate is positioned over the cover means, it is secured in place by pin 59 inserted into tightening clamp 55 which is affixed by screw 56 in bearing 57 which is welded to the periphery of flange 3.

The illustrated mold includes a system for lubricating the internal wall of mold element 14 by injecting a lubricating agent at the level of upper end 10 of the mold element. This lubricating system includes a plurality, four instance four, of injection channels 45 machined into cover 5 and extending radially therethrough. The radial injection channels lead into annular groove 46 in the cover which, in turn opens into very narrow annular space 51 defined between cover 5 and annular lubricating plate 52 which is mounted in cover plate 42, shoulder 44 of the lubricating plate being received in recess 43 of the cover plate. Annular space 51 communicates with the periphery of open end 10 of mold element 14. Flat annular gasket 53 defines the outer limit of annular space 51 and provides a light-tight seal therefor so that any lubricant injected into channels 45 flows through groove 46 and space 51 over the periphery of open end 10 to the internal wall of the mold element. The lubricating plate defines central orifice 65 in alignment with open end 10.

The illustrated flow pattern of liquid coolant, usually water, enables the cooling liquid to cool not only the mold element but also the electromagnetic inductor, the liquid being introduced through conduit 13 into mold chamber 28 whence it passes through ports 27 into inlet chamber 23, through annular port 25 up annular space 21, out through port 26 into outlet chamber 24, where it inundates inductor 28, and out conduit 12.

As will now be explained more particularly in connection with FIG. 2, but as is evident from FIG. 1, the mounting of the mold element and jacket is such that the mold may be readily adapted for molding ingots of different cross sections, simply by replacing the inner part of the mold, the continuous casting mold according to the invention consisting, in fact, of a fixed mold part useful for molding ingots of any shape and designated herein as the "mold body" and a replaceable mold part which is interchangeable to adapt the mold to casting ingots of different cross section, as appears from FIG. 4*a* and 4*b*.

The fixed mold part or mold body comprises outer tubular mold wall 1, tubular casing 2, annular member 32, 33 of liquid-tight element 29, cover means 5 and bottom wall 6. This fixed mold part also includes inlet conduit 13 and outlet conduit 12 for the cooling liquid, and end flanges 3 and 4, which interconnect wall 1 and casing 2, cover plate 42 which is hinged to flange 3. The inlet and outlet chambers for the cooling liquid are also part of this mold body, as is electromagnetic inductor 38 with projecting magnetic poles 47, 47'', the latter being adapted to various shapes of tubular mold elements in a manner which will be described in connection with FIGS. 2, 4*a* and 4*b*.

The replaceable mold part comprises tubular mold element 14 whose cross section conforms to the desired cross section of the ingot to be molded, tubular jacket 22, annular stiffening member 31' of the liquid-tight element, and auxiliary magnetic pole members 69 disposed between the jacket and the projectingpoles of the electromagnetic inductor. The replaceable mold part also includes mounting collar 15 welded to the upper end of the mold element and abutment 40' welded to the exterior wall of the jacket at the lower end thereof, the diameter of abutment 40' and stiffening member 31' exceeding that of abutment 40 and member 31 to accommodate the insertion of the auxiliary magnetic pole members (compare FIGS. 1 and 2) so that the auxilliary pole members adjoin, and are alinged with, corresponding ones of the magnetic poles, as clearly shown in FIG. 4*a* and 4*b*.

As illustrated in FIG. 4*a* (or 4*b*), auxiliary pole members 69*a* (or 69*b*) constitute extensions of magnetic poles 47 in the direction of the casting, the auxiliary pole members in the illustrated embodiment being welded to jacket 22 so that the jacket has the configuration of a channelled tube whose ribs are constituted by auxiliary pole members 69*a*. The outer surfaces of the auxiliary pole members mate with contacting faces of the inductor poles. As shown in FIG. 2, it is preferred to leave an air gap or clearance 79, for instance of the order of width of 0.5 mm, between the mating faces of the inductor poles and auxiliary pole members to facilitate the assembly of the poles with the mating pole members without damaging the inductor poles and thus lose magnetic flux.

The means for assembling the fixed and replaceable mold parts includes mounting flange 70 designed essentially to extend the diameter of mounting collar 15 of mold element 14 so as to accommodate the inserted auxiliary pole members 69 in a manner similar to the extension of the diameters of abutment 40' and annular stiffening member 31'. In the modification of FIG. 2, mounting flange 70 is welded to the upper end of the mold element, toroidal gasket 63' being received in annular groove 66' in shoulder 17' of flange 70 to provide a liquid-tight joint around the open end of the mold element. Mounting collar 15 is received in annular recess 16' of mounting flange 70 which as a bearing 71 received in annular recess 16 of cover 5. Rubber gaskets 63 and 63' assure a liquid-tight seal between outlet chamber 24 for the cooling liquid and the lubricating agent injected through channels 45. As shown, the dimensions of bearing 71 and mounting collar 15 are identical so that, depending on the radial dimension of the inductor, the mold element may be suspended on cover 5 either by the bearing or the mounting collar, either one fitting into recess 16. This will be possible only where the diameter of the central orifice of cover 5 is large enough to accommodate adapter flante 70. Where this is the case, the mold will be adapted to different inductor diameters by use of adapter flange 70 at the upper end of the mold element and adapter flange 75 at the lower end thereof. The adapter flange 75 merely constitues a larger diameter version of wedge 19 (FIG. 1), being screwed to flange 6 by its bearing 80 and defining annular groove 67' for seating toroidal rubber gasket 18' which is equivalent in function to gasket 18 in the embodiment of FIG. 1.

Three additional modifications of adapter flange 70 are shown in FIGS. 3*a*, 3*b* and 3*c*. According to FIGS. 3*a*, bearing 71*a* of adapter flange 70*a* is again received in annular recess 16 of cover 5 but, contrary to the modification of FIG. 2, flange 70*a* has recess 72 in its lower face for receiving mounting collar 15, the mounting collar being supported and suspended on ring 73 affixed to mounting flange 70*a* by bolt 74. Gasket 63' is replaced by two flat rubber gaskets 77 and 77' disposed between the upper and lower faces of mounting collar 15 and adjoining faces of the mounting flange and ring.

In the modification of FIG. 3*b*, bearing 71*b* of adapter flange 70*b* is received in annular recess 72' in the lower face of cover 5, the adapter flange being affixed to the cover by bolt 74' and gasket 81 being seated in annular groove 81 in the adapter flange between the flange and the cover. As in the modification of FIG. 3*a*, the adapter flange has recess 72 receiving mounting collar 15 and the mounting collar is supported and suspended on ring 73.

As the like reference numerals indicate, the connection between cover 5 and adapter flange 70*c* in the modification of FIG. 3*c* is identical to that of FIG. 3*b* but collar 15 is received in annular recess 16' in the upper face of the adapter flange, rubber gasket 63' being received in annular groove 66' in the shoulder of flange 70*c*.

All illustrated adapters function alike. In the absence of the adapter flange, collar 15 can be used to mount the mold element directly on cover 5. In the modifications of FIGS. 3*b* and 3*c*, mounting collar 15 will have a threaded bore for receiving mounting bolts 74' used to mount the mold element on the cover.

The FIG. 4*a* illustrates the mold of FIG. 2 with a tubular mold element 14 of circular cross section for molding round ingots while FIG. 4*b* shows a mold element cross section for molding rectangular ingots, the same reference numerals being used to designate like parts so as to avoid redundancy in the description. The illustrated inductor will be described in detail in connection with FIG. 5.

Auxiliary pole members 69*a* in FIG. 4*a* or 69*b* in FIG. 4*b* are of magnetic material such as magnetic steel, and may be machined of a single piece or be laminated, as desired. In the illustrated embodiments, the tongues affixed to the exterior wall of the jacket 22 to prevent rotation of the inducteur due to electromagnetic reaction forces are designated by the references 54*a* (FIG. 4*a*) and 54*b* (FIG. 4*b*), the auxiliary pole members 69*a* (or 69*b*) have parallel lateral walls 83, 83' but these walls, as well as the lateral walls of the magnetic poles 47, may also extend in radial planes, if desired, and such a configuration would serve to maintain a constant relationship between the total surface of the casting and the surface subjected to the action of the magnetic field, regardless of the dimensions of the cross section of the casting.

FIG. 5 is a detailed sectional view of the electromagnetic inductor, like reference numerals designating like parts of the inductor previously described. Mounting cylinder 50 of the inductor is constituted by a stack of magnetic sheets of small gage, such as of the order of 0.5 mm, which are assembled by tie rods 84 held in place by nuts 85 and washers 86. Four diametrically opposed magnetic poles 47 are disposed along interior wall 87 of cylinder 50 and are affixed thereto by screws 88 arranged along a longitudinal generatrix of the cylinder and anchored in a longitudinal steel insert 89 at the interior of each pole. Like cylinder 50, each pole 47 is constituted by a stack of magnetic sheets of small gage, such as of the order of 0.5 mm, which are assembled by tie rods 90 held in place by nuts 91 and washers 92. The compactness of the stack may be increased, as shown, by using supplemental tie rods 93 at the lateral ends of each pole, which tie rods may have a diameter smaller than that of tie rods 90. Each pole is so shaped that its interior wall facing the casting is concave and mates with the corresponding longitudinal wall portion of jacket 22 with which it is held in free contact.

Each magnetic pole 47 is surrounded by two superposed electrical windings 94 and 95 separated and insulated from each other by epoxy glass ribs 96. Like ribs 97 separate the poles from inner winding 94. Each winding has 16 turns and the copper wire used for the windings is of rectangular cross section, 14.5 mm long and 3 mm thick. The windings are held in position by epoxy glass ribs 101 and 101', the windings receiving electric current through terminals 102 connected to an electric power source (not shown). These electrical connections pass through a liquid-tight box in outer wall 1 of the mold.

The illustrated electromagnetic inductor functions like the stator of an asynchronous electric motor whose rotor is constituted by the liquid metal cast continuously through the mold passage which is in the center of the inductor. The windings of each magnetic pole are connected to one phase of a source of poly-phase current so as to produce a magnetic field perpendicular to the axis of the casting, with a speed directly proportional to the frequency of the current fed to the inductor windings. For instance, a four-phased current of a frequency of 6 Hz and an intensity of 320 A may be supplied to each winding, under a potential difference of 27 V per phase with respect to zero. The available power is then 38 kVA, with a power factor of the order of 0.6. The magnetic field produced by such an inductor is of the order of 800 Gauss in the axis of the casting, despite the weakening of the field due to the field having to traverse mold element 14 of a copper-chromium alloy.

The herein described and illustrated mold may be used in all types of continuous casting, whether in vertical casting, as described in connection with the illustrated embodiments, or in casting along slightly inclined axis, in which case the axis of the mold is oblique with respect to the horizontal, or in continuous casting along a curvilinear path, in which case the mold is correspondingly curvilinearly shaped.

While certain preferred embodiments have been specifically described and illustrated, it will be obvious to those skilled in the art that many modifications and variations are possible. For instance, the functions of the inlet and outlet chambers for the cooling liquid may be interchanged, the inlet chamber becoming the outlet chamber and the film of cooling liquid descending in annular space 21 instead of ascending therein. The number of inductor poles may obviously be varied, as may be the number of phases and the frequency of the electric current supplied to the inductor windings. Similarly, while the mold structure has been illustrated as tubular because this appears to be the most practical embodiment, particularly as far as the electromagnetic inductor is concerned, various other forms are feasible. Also, the means for assembling the replaceable part of the mold with its fixed part may take a variety of forms equivalent in function to those illustrated. The inductor poles may be assembled with the auxiliary pole members by any suitable means, such as mortise-and-tenon joints, and any means permitting the poles to be slidingly moved in relation to the auxiliary pole members during their assembly. Similarly, the auxiliary pole members may be assembled with the jacket in any suitable manner but it will be preferred to make them integral with each other by welding, rivetting, bonding, screwing together, or the like.

If desired, the mold may be placed on an oscillating table or frame, as is well known.

What is claimed is:

1. A liquid-cooled mold for the continuous casting of molten metal, comprising the combination of

1. a tubular mold element of non-magnetic material having two open ends and defining a passage for the casting between the open ends,

2. a tubular jacket of non-magnetic material surrounding the tubular mold element and defining an annular space therewith,

3. a tubular casing surrounding the jacket and defining a chamber therewith,

4. a liquid-tight element dividing the chamber into a lower inlet chamber for a cooling liquid and an upper outlet chamber for the liquid, a. the inlet and outlet chambers being adjoining but separated by the liquid-tight element, b. the outlet chamber extending over a substantial part of the length of the jacket, c. the annular space communicating at the respective ends of the jacket with the inlet and outlet chambers, respectively, whereby a film of the cooling liquid circulates through the annular space when the liquid is supplied to the inlet chamber, and d. the liquid-tight element comprising two annular members, a first one of the annular members being affixed to the interior wall of the tubular casing near the lower end thereof and a second one of the annular members being affixed to the exterior wall of the tubular jacket near the lower end thereof, whereby the liquid-tight element supports the jacket at its lower end, the upper end of the jacket being free of support,

5. cover means for the mold, the cover means delimiting the upper outlet chamber,

6. a bottom wall for the mold, the bottom wall delimiting the lower inlet chamber, a. the cover means and bottom wall having central orifices in alignment with the open ends of the tubular mold element,

7. support means at the upper end of the tubular mold element for holding the tubular mold element in the central orifice of the cover means,

8. liquid-tight centering means for holding the lower end of the tubular mold element in the central orifice of the bottom wall, a. the centering means providing a resilient coupling between the tubular mold element and the bottom wall,

9. an electromagnetic inductor means arranged in the upper outlet chamber and having projecting poles, the inductor means surrounding the jacket for moving the molten metal in the passage, and

10. means on exterior wall of the tubular jacket for supporting the inductor means in the outlet chamber.

2. The liquid-cooled mold of claim 1, wherein the support means at the upper end of the tubular mold element comprises a collar affixed to the upper tubular mold element end and an annular recess defined by the cover means and receiving the collar.

3. The liquid-cooled mold of claim 1, wherein the liquid-tight centering means comprises a toroidal gasket of resilient material and an annular groove defined in the bottom wall around the central orifice thereof and receiving the gasket, the exterior wall of the tubular mold element pressing thereagainst.

4. The liquid-cooled mold of claim 1, wherein the first annular member of the liquid-tight element is a ring and the second annular member thereof is a stiffening metal plate; the metal plate carries an annular skirt extending towards the ring and defining an annular space with the jacket, the ring carries an annular ridge extending towards the metal plate between the skirt and the jacket, and a liquid-tight gasket is arranged in the annular space between the skirt and the jacket, the ridge supporting the gasket in the annular space.

5. The liquid-cooled mold of claim 1, further comprising a collar affixed to the exterior wall of the jacket and constituting an abutment maintaining the inductor means in position in the outlet chamber.

6. The liquid-cooled mold of claim 1, further comprising tongue means affixed to the exterior wall of the jacket and disposed between consecutive ones of the magnetic poles of the inductor means, the tongue means being arranged to prevent rotation of the inductor means.

7. The liquid-cooled mold of claim 1, designed for molding ingots of different cross sections and consisiting of a fixed mold part comprising the tubular casing, the first annular member of the liquid-tight element, the cover means, and the bottom wall, and replaceable mold part comprising the tubular mold element, the cross section of this element conforming to the desired cross section of the ingot to be molded, the tubular jacket, the second annular member of the liquid-tight element, and auxiliary magnetic pole members disposed between the jacket and the projecting poles of the magnetic inductor means, and further comprising means for assembling the fixed and replaceable mold parts so that the auxiliary magnetic pole members adjoin, and are aligned with, corresponding ones of the poles.

8. The liquid-cooled mold of claim 7, further comprising means for assembling the auxiliary magnetic pole members with associated ones of the projecting poles, the assembling means permitting the magnetic pole members and the associated poles to glide relative to each other during assembly.

9. The liquid-cooled mold of claim 7, wherein the auxiliary magnetic pole members are integral with the jacket whereby the jacket forms an outwardly channelled tube, the channels of the tube being defined between the auxiliary magnetic pole members extending the length of the jacket.

10. The liquid-cooled mold of claim 7, wherein the means for assembling the fixed and replaceable mold parts comprises the support means at the upper end of the tubular mold element and the centering means for holding the lower end of the tubular mold element in the central orifice of the bottom wall.

11. The liquid-cooled mold of claim 10, wherein the support means comprises a collar affixed to the upper tubular mold element end and an adapter flange mounted on the cover means, the adapter flange adapting the diameter of the central orifice of the cover means and having an annular recess receiving the collar.

12. The liquid-cooled mold of claim 11, wherein the cover means defines an annular recess of the same dimension as the recess in the adapter flange, the adapter flange having a bearing portion received in the annular recess in the cover means.

13. The liquid-cooled mold of claim 10, wherein the centering means comprises an adapter ring mounted on the bottom wall and adapting the diameter of the central orifice of the bottom wall, and the adapter ring defining an annular groove, a toroidal gasket of resilient material being received in the annular groove around the central orifice, the exterior wall of the tubular mold element pressing against the toroidal gasket.

14. The liquid-cooled mold of claim 9, wherein the auxiliary pole members and associated ones of the pole members define a narrow air gap therebetween.

* * * * *